US009979146B2

(12) United States Patent
Vishwanath et al.

(10) Patent No.: US 9,979,146 B2
(45) Date of Patent: May 22, 2018

(54) CONNECTOR HOUSING ASSEMBLY AND ELECTRICAL CONNECTOR ASSEMBLY

(71) Applicants: TE Connectivity India Private Limited, Bangalore (IN); TE Connectivity Germany GmbH, Bensheim (DE)

(72) Inventors: Attad Vishwanath, Bengaluru (IN); Frank Wittrock, Schriesheim (DE); Martin Listing, Langen (DE)

(73) Assignees: TE Connectivity India Private Limited, Bangalore (IN); TE Connectivity Germany GmbH, Bensheim (DE)

( * ) Notice: Subject to any disclaimer, the term of this patent is extended or adjusted under 35 U.S.C. 154(b) by 0 days. days.

(21) Appl. No.: 15/352,926

(22) Filed: Nov. 16, 2016

(65) Prior Publication Data

US 2017/0149186 A1 May 25, 2017

(30) Foreign Application Priority Data

Nov. 23, 2015 (IN) ..... 6291/CHE/2015

(51) Int. Cl.

| | |
|---|---|
| ***H01R 13/02*** | (2006.01) |
| ***H01R 24/78*** | (2011.01) |
| ***H01R 13/6582*** | (2011.01) |
| ***H01R 13/46*** | (2006.01) |
| ***H01R 13/627*** | (2006.01) |
| ***H01R 13/631*** | (2006.01) |
| ***H01R 13/52*** | (2006.01) |
| ***H01R 13/58*** | (2006.01) |

(Continued)

(52) U.S. Cl.

CPC ..... *H01R 24/78* (2013.01); *H01R 13/46* (2013.01); *H01R 13/5202* (2013.01); *H01R 13/5208* (2013.01); *H01R 13/5841* (2013.01); *H01R 13/6272* (2013.01); *H01R 13/631* (2013.01); *H01R 13/6582* (2013.01); *H01R 13/74* (2013.01); *H01R 13/506* (2013.01); *H01R 13/5219* (2013.01); *H01R 13/5221* (2013.01); *H01R 24/20* (2013.01); *H01R 24/66* (2013.01); *H01R 2103/00* (2013.01)

(58) Field of Classification Search

CPC ..... H01R 29/00

USPC ..... 439/170, 171, 218, 222, 640, 638, 6, 8, 439/11, 173; 174/87

See application file for complete search history.

(56) References Cited

U.S. PATENT DOCUMENTS 1,607,807 A * 11/1926 Anderson ..... F21V 21/14 174/69

1,747,896 A * 2/1930 Gates ..... H01R 24/76 439/682

(Continued)

*Primary Examiner* — Neil Abrams

(74) *Attorney, Agent, or Firm* — Barley Snyder

(57) ABSTRACT

A connector housing assembly is disclosed. The connector housing assembly has a connector housing and a mating connector housing. The connector housing has a cable receptacle open in a cable direction. The mating connector housing has a contact receptacle open in a contact direction. The mating connector housing is connectable with the connector housing in a first position in which the cable direction and the contact direction are substantially perpendicular to each other and a second position in which the cable direction and contact direction are substantially parallel to each other.

17 Claims, 10 Drawing Sheets

(51) Int. Cl.

| | |
|---|---|
| ***H01R 13/74*** | (2006.01) |
| *H01R 103/00* | (2006.01) |
| *H01R 13/506* | (2006.01) |
| *H01R 24/20* | (2011.01) |
| *H01R 24/66* | (2011.01) |

(56) References Cited

U.S. PATENT DOCUMENTS 2,916,720 A * 12/1959 Steans ..... H01R 24/28 439/370
3,097,906 A * 7/1963 Shannon ..... H01R 11/22 439/224
3,419,844 A * 12/1968 Schmued ..... H01R 13/33 439/364
3,474,376 A * 10/1969 Preiss ..... H01R 13/56 439/171
3,601,746 A * 8/1971 Teagno ..... H01R 13/20 403/103
3,711,815 A * 1/1973 Pierce ..... H01R 13/562 174/86
3,795,883 A * 3/1974 Ackerman ..... H01R 27/00 439/106
3,986,762 A * 10/1976 Reeder ..... H01R 27/00 439/218
4,959,021 A * 9/1990 Byrne ..... H01R 13/4538 439/1
5,380,219 A * 1/1995 Klier ..... H01R 13/562 439/446
5,681,171 A * 10/1997 Park ..... H01R 35/02 439/210
5,692,921 A * 12/1997 Jennings ..... H01R 13/20 439/173
6,030,241 A * 2/2000 Chiba ..... H01R 12/712 439/222
6,050,853 A * 4/2000 Ando ..... H01R 12/716 439/571
6,338,645 B1 * 1/2002 Tan ..... H01R 13/5841 439/446
6,663,396 B1 * 12/2003 Wang ..... H01R 13/652 439/31
6,790,093 B2 * 9/2004 Tanaka ..... H01H 11/0031 439/218
6,907,122 B2 * 6/2005 Chiang ..... H01R 35/02 379/433.13
6,945,814 B2 * 9/2005 Snape ..... H01R 35/02 439/165
7,258,574 B2 * 8/2007 Barringer ..... H05K 9/0058 439/607.01
7,722,402 B2 * 5/2010 Pepe ..... H01R 13/518 439/607.18
7,811,136 B1 * 10/2010 Hsieh ..... H01R 24/60 439/11
8,206,159 B2 * 6/2012 Naito ..... H01R 12/7082 439/65
8,226,419 B2 * 7/2012 Fonzo ..... H01R 35/02 439/11
8,262,413 B2 * 9/2012 Fujiwara ..... H01R 13/6596 439/607.28
8,435,065 B2 * 5/2013 Littek ..... H01R 13/5841 439/173
8,777,671 B2 * 7/2014 Huang ..... H01R 35/04 439/11
8,894,420 B2 * 11/2014 Schichl ..... H01R 13/5841 439/39
9,071,022 B2 * 6/2015 Lee ..... H01R 13/642
9,153,889 B2 * 10/2015 Germ ..... H01R 13/02
9,214,791 B1 * 12/2015 Peplinski ..... H02B 1/066
9,600,040 B1 * 3/2017 Han ..... G06F 1/20
9,653,839 B2 * 5/2017 Andresen ..... H01R 13/5841

* cited by examiner

CONNECTOR HOUSING ASSEMBLY AND ELECTRICAL CONNECTOR ASSEMBLY

CROSS-REFERENCE TO RELATED APPLICATION

This application claims the benefit of the filing date under 35 U.S.C. § 119(a)-(d) of Indian Patent Application No. 6291/CHE/2015, filed on Nov. 23, 2015.

FIELD OF THE INVENTION

The present invention relates to a connector housing assembly, and more particularly, to a connector housing assembly of an electrical connector.

BACKGROUND

Connector housing assemblies of electrical connectors having a connector housing and a mating connector housing are known in the art. In angled electrical connectors, the connector housing and the mating connector housing are formed to be mated at only one angle. In order to obtain a different mating angle, another connector housing assembly or at least another connector housing must be manufactured.

FIG. 1 shows an electrical connector assembly 2 of the prior art. Two possible electrical connector assemblies 2 are shown, each comprising an electrical connector 4 and a mating connector 6. The electrical connector 4 has a conductor 157 embodied as a cable 33 and the mating connector 6 has a mating conductor 159 embodied as a contact. Two different connector housings 3 are used for the connectors 4. The connector housing 3*a* is a 90° connector housing and connector housing 3*b* is a 180° connector housing. Both connector housings 3*a*, 3*b* are configured to be plugged to the mating connector housing 5 embodied as a header housing 5*a*, which is used for the mating connector 6. As shown in FIG. 1, to change the mating angle formed by the connector housing assembly 1, one of the connector housing 3 or the mating connector housing 5 has to be replaced by a different embodiment of the respective housing.

Furthermore, in an electrical connector with a mating angle of 90°, contact pins cannot be inserted into the connector housing 3*a*. Contact pins of such prior art electrical connectors thus either require several parts or must be molded into the connector housing 3*a*. A contact pin comprising several parts has a higher contact resistance resulting in a decrease of the power that can be transmitted by such an angled housing assembly. Additionally, in an electrical connector with a mating angle of 180°, such as the connector housing 3*b* with the mating connector housing 5, an additional 90° plug needs to be incorporated into the system. The additional element also increases the contact resistance. Prior art connector housing assemblies thus require numerous parts for different mating angles, increasing cost and contact resistance.

SUMMARY

An object of the invention, among others, is to provide a connector housing assembly which may be used in different mating positions without requiring additional elements. The disclosed connector housing assembly has a connector housing and a mating connector housing. The connector housing has a cable receptacle open in a cable direction. The mating connector housing has a contact receptacle open in a contact direction. The mating connector housing is connectable with the connector housing in a first position in which the cable direction and the contact direction are substantially perpendicular to each other and a second position in which the cable direction and contact direction are substantially parallel to each other.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
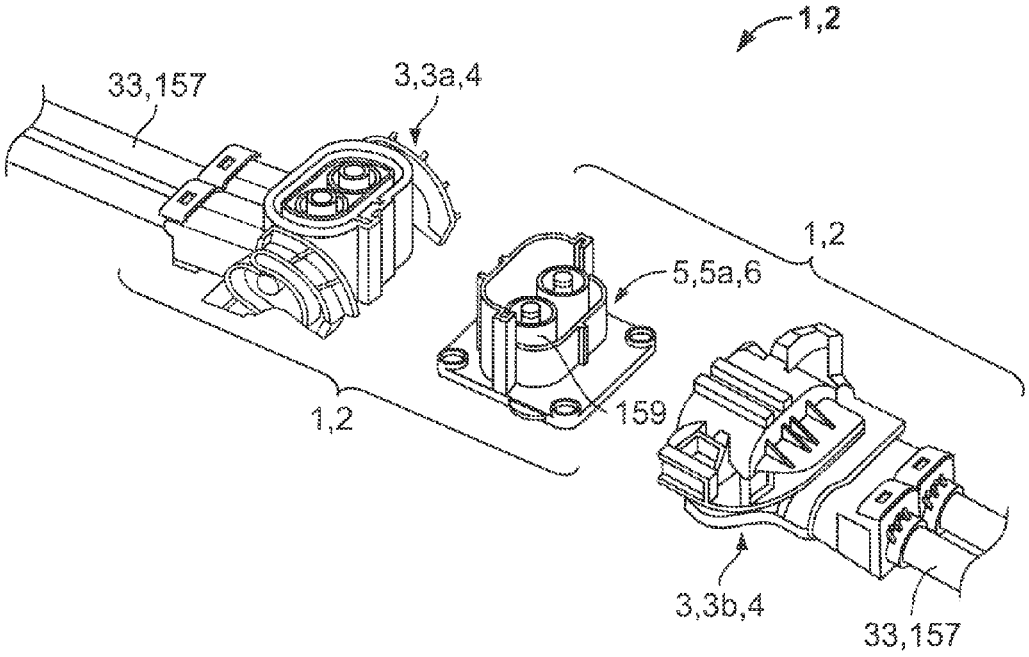
Fig. 1 PRIOR ART
FIG. 1 is a perspective view of an electrical connector according to the prior art.

Embodiments of the present disclosure will be described hereinafter in detail with reference to the attached drawings, wherein the like reference numerals refer to the like elements. The present disclosure may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 2:
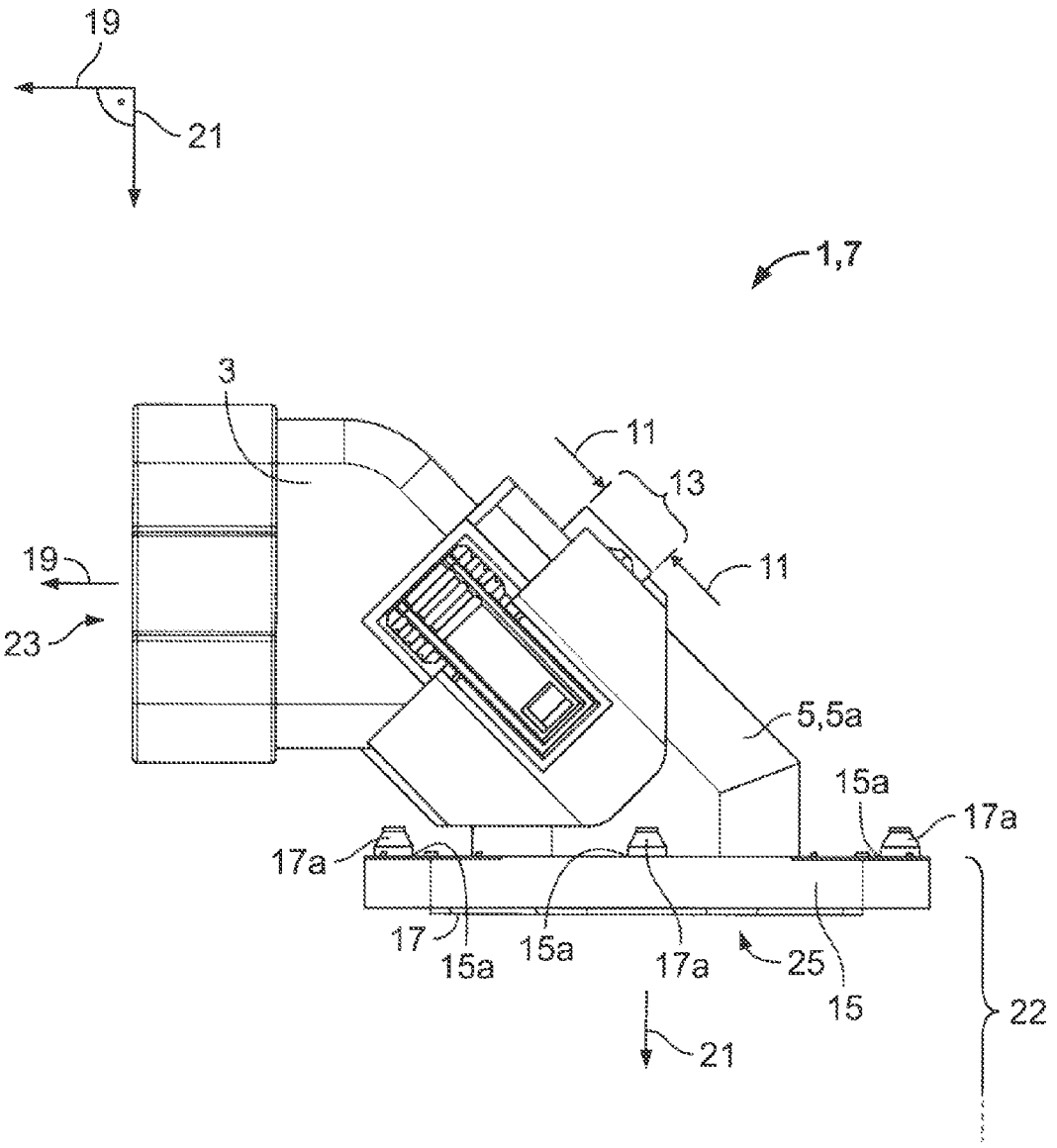
FIG. 2 is a perspective view of a connector housing assembly according to the invention in a first position.
Figure 3:
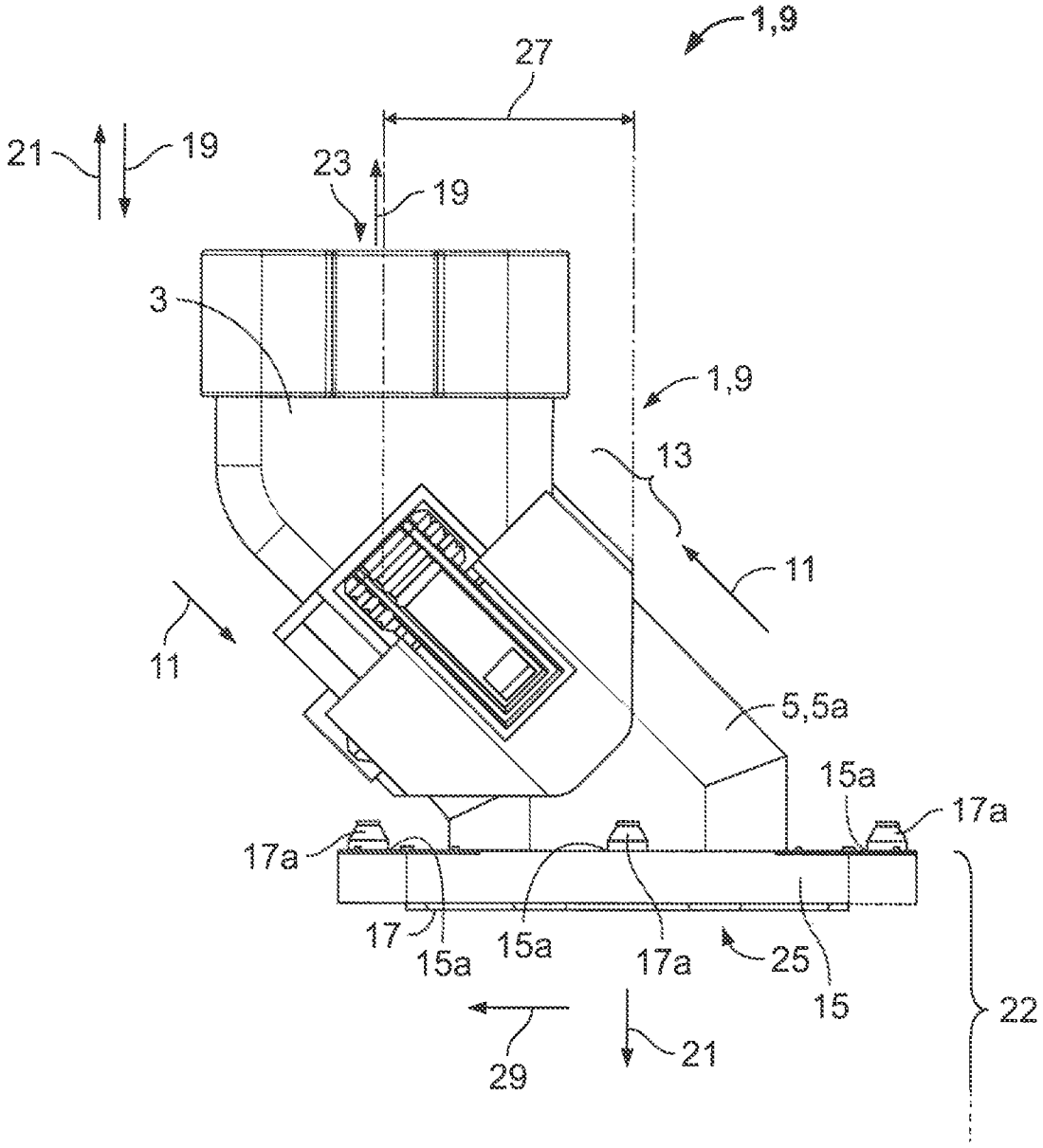
FIG. 3 is a perspective view of the connector housing assembly of FIG. 2 in a second position.

A connector housing assembly 1 according to the invention is shown generally in FIGS. 2 and 3. The connector housing assembly 1 has a connector housing 3 and a mating connector housing 5. The major components of the invention will now be described in greater detail.

Figure 4:
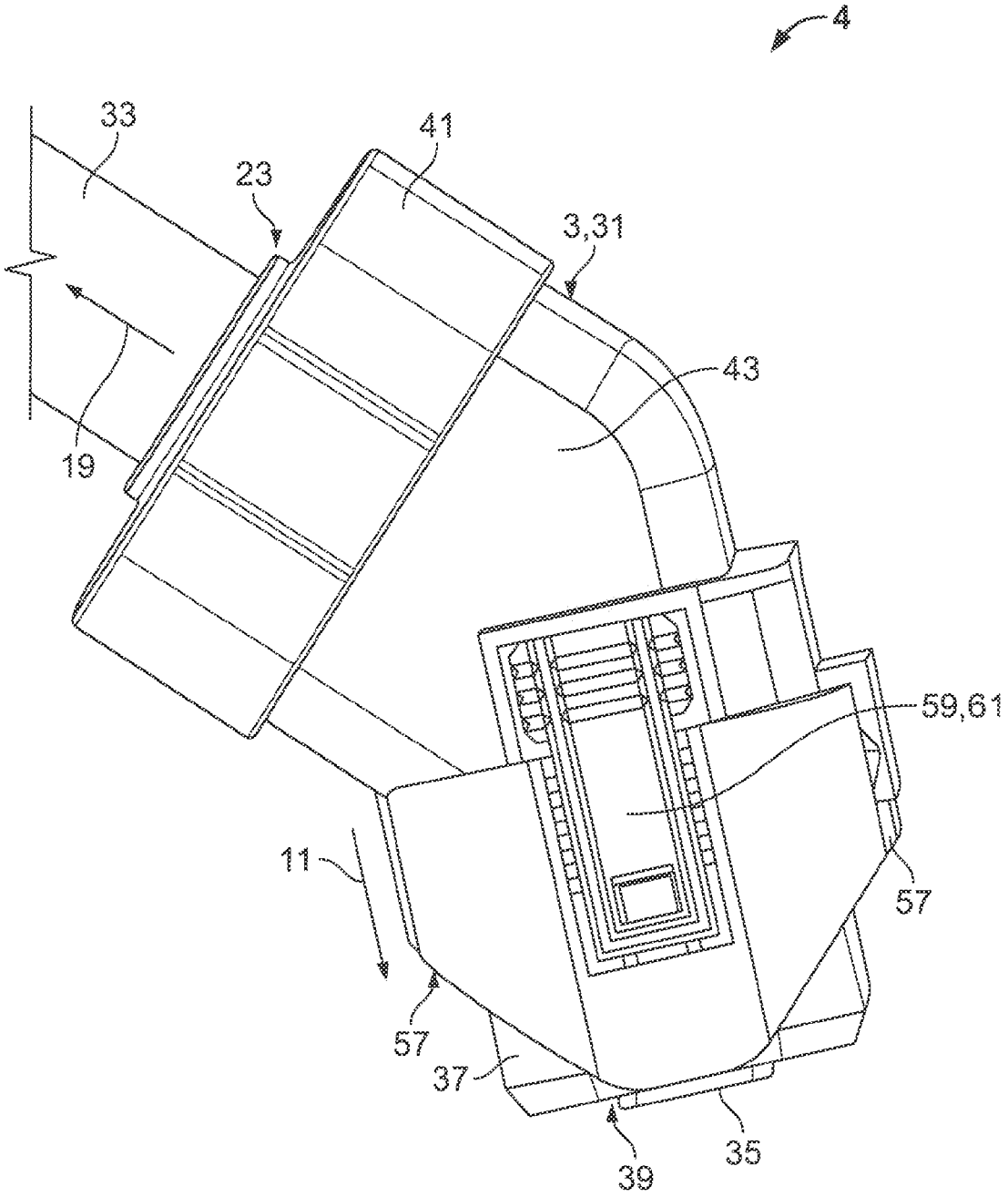
FIG. 4 is a perspective view of a connector housing.

An electrical connector 4 comprising the connector housing 3 in an assembled state 31 is shown in FIG. 4. The electrical connector 4 is the connector housing 3 in a state prepared to connect with the mating connector 5. The electrical connector 4 comprises an electrical conductor 157, embodied as a cable 33, and an inner connector housing 35. The cable 33 is received in a cable receptacle 23 of the connector housing 3 counter to a cable direction 19. The cable 33 is centered and fixed by a cable seal retainer 41 which is put over an outer housing 43 and which holds a cable seal sealing the inside of the outer housing 43 against fluids and dust. The inner connector housing 35 is enclosed by a peripheral seal retainer 37 and is received in a connection receptacle 39 of the connector housing assembly 1. The electrical connector 4 also has guiding grooves 57. A locking latch 61 is formed on an exterior of the connector housing 3.

Figure 5:
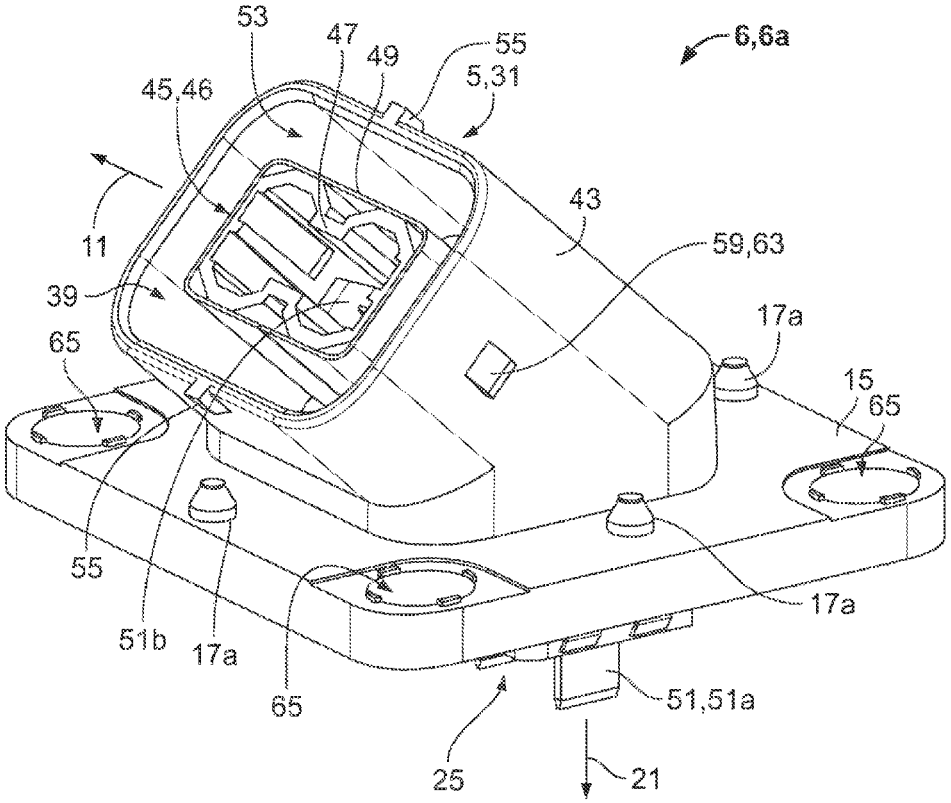
FIG. 5 is a perspective view of a mating connector housing.
Figure 12:
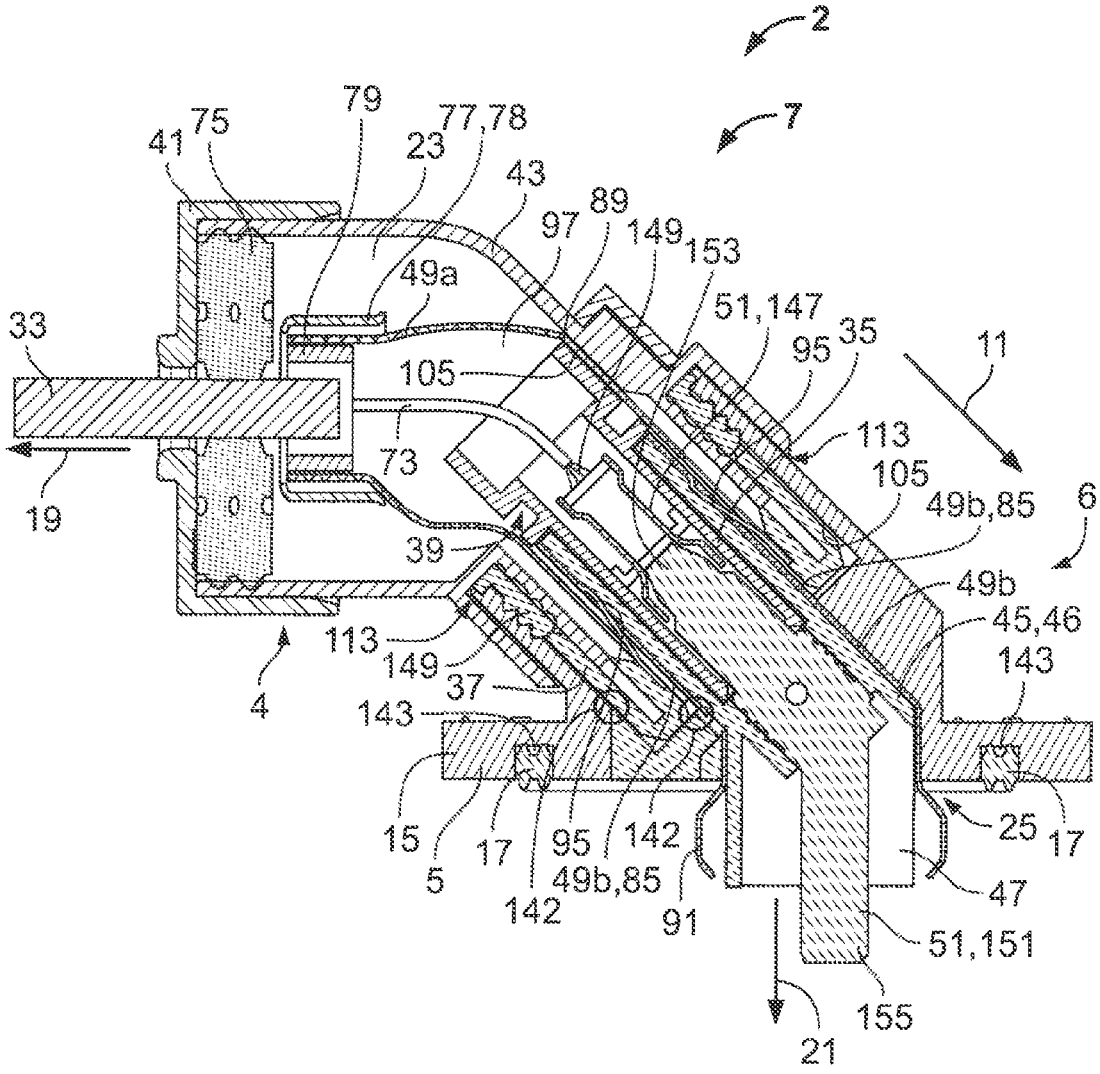
FIG. 12 is a sectional view of an electrical connector having the connector housing assembly of FIG. 2.

The mating connector housing 5 shown in FIGS. 2 and 3 is formed as a header 5*a* comprising a flange 15 which is adapted to attach the header 5*a* to a wall by a plurality of fixation openings 65, shown in FIG. 5. The mating connector housing 5 has an axial seal 17, as shown in FIGS. 2 and 3. The axial seal 17 is positioned on a contact of the header 5*a* and it is applied to seal a wall opening against fluids and dust. The axial seal 17 is received in a seal groove 143 located at the contact of the flange 15, as shown in FIG. 12. The axial seal 17 is held in the correct position by means of seal pins 17*a*. The seal pins 17*a* extend from the axial seal 17 counter to a contact direction 21 and are received in seal passageways 15*a* of the flange 15. The mating connector housing 5 also has a contact side 22.

A mating electrical connector 6 formed as a header 6*a* with the mating connector housing 5 is shown in FIG. 5. The mating electrical connector 6 has an outer housing 43 which receives a mating connector insert 45. The mating connector insert 45 is a header insert 46 comprising an inner mating connector housing 47 which is encircled by a shield 49. The mating electrical connector 6 has an electric mating conductor 159 embodied as a contact 51. A first contact element 51*a* extends from a contact receptacle 25 of the mating electrical connector 6 in a contact direction 21 and into the inner mating connector housing 47. A second contact element 51*b* extends in the contact direction 21 out of the contact receptacle 25. The header insert 46 is centered in the connection receptacle 39, forming a mating clearance 53 which is a free space between the header insert 46 and the outer housing 43. The mating electrical connector 6 has guiding members 55. A detent hook 63 is formed on an exterior of the mating connector housing 5.

The connector housing 3 and the mating connector housing 5 are connected to each other in a first position 7, shown in FIG. 2, and a second position 9, shown in FIG. 3. The connector housing 3 and the mating connector housing 5 in FIGS. 2 and 3 have been plugged together along a plug direction 11 forming a connecting section 13.

The guiding members 55 are received in the guiding grooves 57 order to guide the connector housing 3 when plugged along the plug direction 11 with the mating connector housing 5. When the connector housing 3 and the mating connector housing 5 are plugged to each other, the detent hook 63 abuts the guiding member 55 of the mating connector housing 5 and deflects a flexible arm 111, shown in FIG. 7A, away from the connection receptacle 39 and upon sufficient insertion of the housing 3, 5 into each other, the detent hook 63 engages behind the guiding member 55, thus locking both housings 3, 5 to each other.

The plug direction 11 for the connector housing 3 and the mating connector housing 5 are parallel to each other but opposite in their direction. FIGS. 2 and 3 further show the cable direction 19 and the contact direction 21. In the first position 7, the cable direction 19 and the contact direction 21 are perpendicular to each other as shown in FIG. 2, whereas in the second position 9, the cable direction 19 and the contact direction 21 are parallel to each other as shown in FIG. 3. The contact receptacle 23 is oriented along the contact direction 21 and the cable receptacle 23 is oriented along the cable direction 19. In the second position 9 shown in FIG. 3, the cable receptacle 23 and the contact receptacle 25 are oriented parallel to each other, but the cable receptacle 23 is offset laterally in a lateral direction 29 by an offset distance 27. The cable direction 19 and the plug direction 11 are at an angle of at least approximately 45° to each other and the contact direction 21 and the plug direction 11 are at an angle of at least approximately 45° to each other.

Figure 6A:
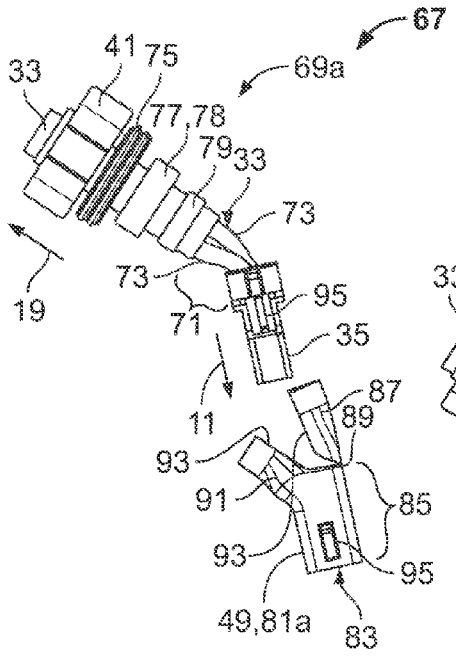
FIG. 6A is a side view of a connector insert in a pre-assembly state.
Figure 6B:
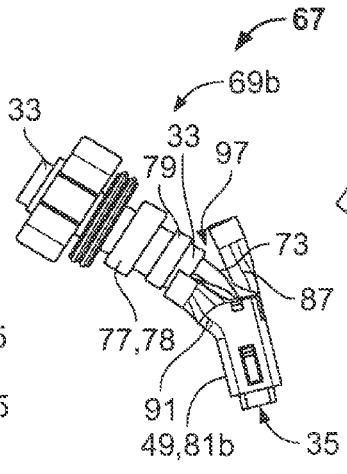
FIG. 6B is a side view of the connector insert in an inserted state.
Figure 6C:
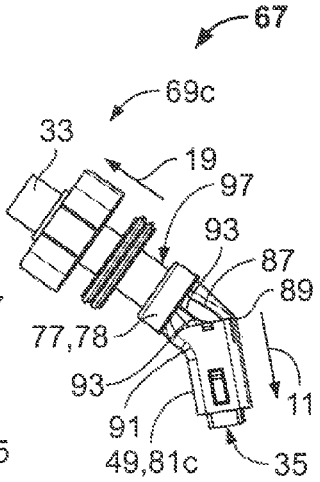
FIG. 6C is a side view of the connector insert in a final state.

A connector insert 67 for the electrical connector 4 comprises the shield 49, the inner connector housing 35, and the cable 33. FIG. 6 shows the assembly of the connector insert 67, showing a pre-assembly state 69*a* in FIG. 6A, an inserted state 69*b* in FIG. 6B and a final state 69*c* in FIG. 6C.

The cable 33 has an unshielded region 71 in which cores 73 of the cable 33 are exposed. In the embodiment shown in FIG. 6, the cable 33 is a two-core cable, but any multi-core cable may be used. Lead wires 149 of the two cores 73, as shown in FIG. 12, are received in the inner connector housing 35, whereas the cable 33 is oriented in the cable direction 19 and the inner connector housing 35 is oriented along the plug direction 11. Both directions 11, 19 are at an angle of 45° to each other, whereas the two cores 73 provide the necessary bending by 135° in the unshielded region 71.

Figure 8:
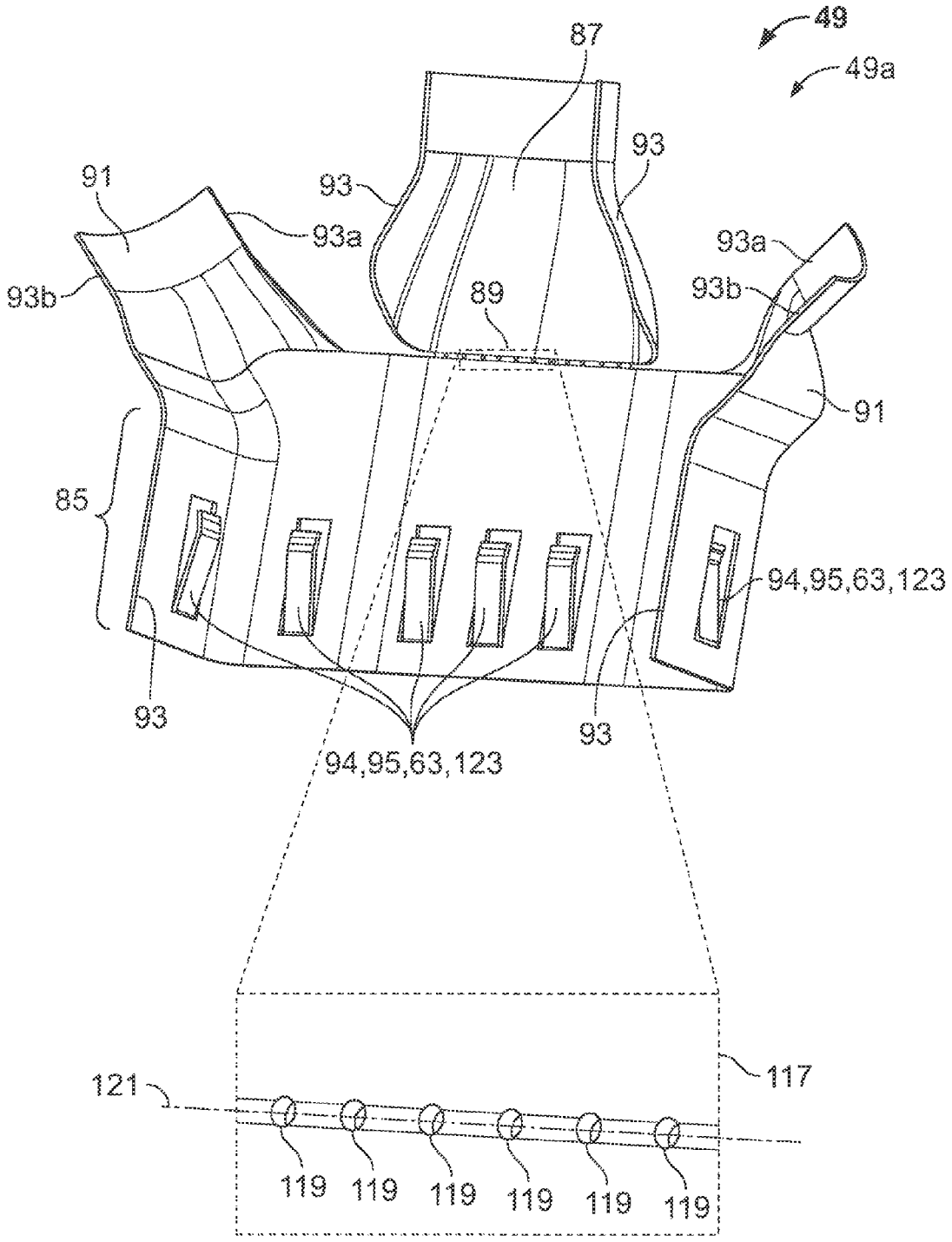
FIG. 8 is a perspective view of a connector shield.
Figure 9:
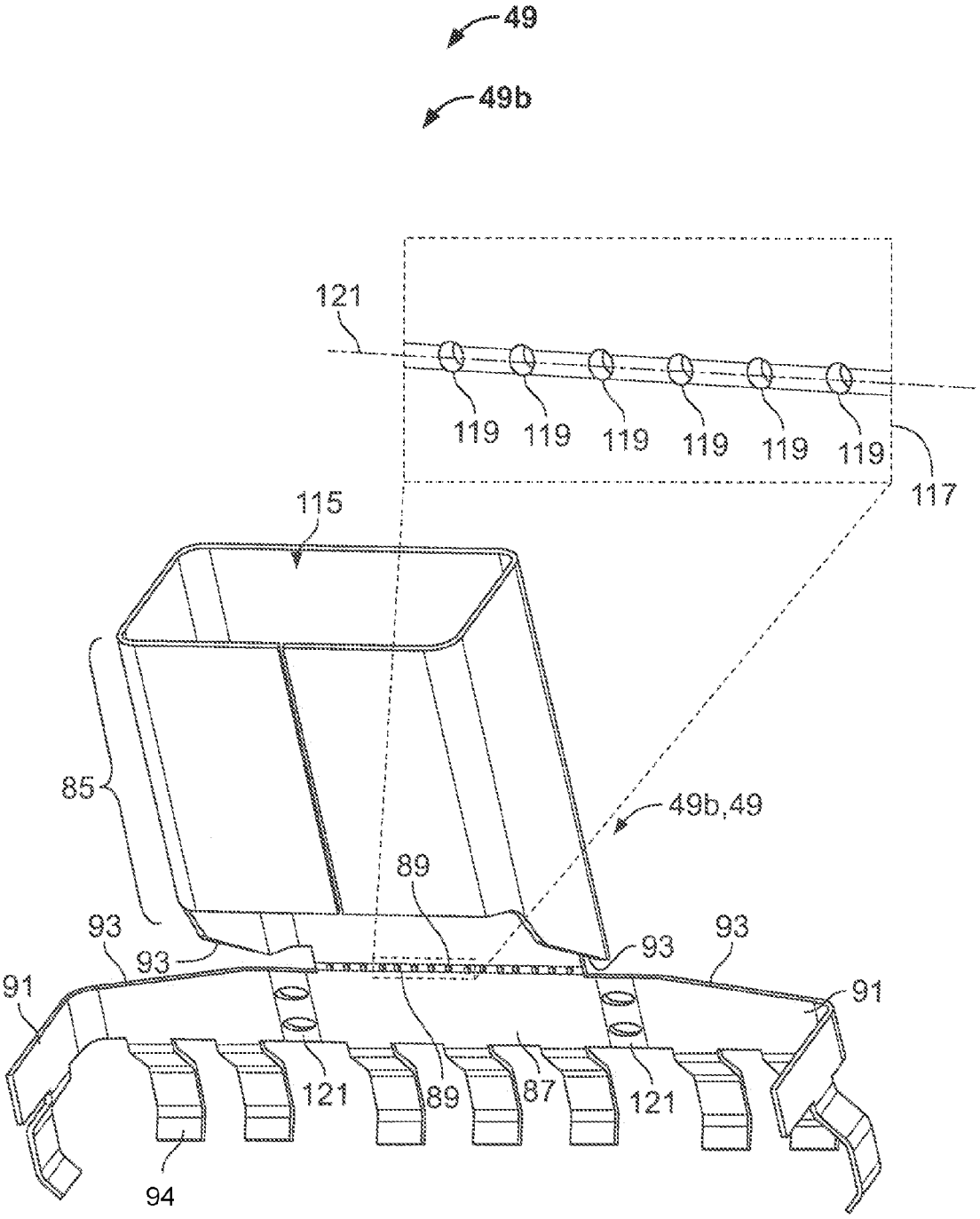
FIG. 9 is a perspective view of a mating shield.

The connector insert 67 further comprises the cable seal retainer 41, a cable seal 75, an outer crimp ferrule 77 and an inner crimp ferrule 79. The outer crimp ferrule is a retaining element 78. The shield 49 shown in FIGS. 6A and 6B is in a first crimp state 81*a*, in which an inner housing recess 83 is enclosed by a first portion 85 of the shield 49. The shield 49 furthermore comprises a hood portion 87, which is attached to the first portion 85 at a hinge line 89 and which is oriented along the plug direction 11. Two wing portions 91 are monolithically formed with the first portion 85 of the shield 49 and are oriented along the cable direction 19 when the first portion 85 encloses the inner housing recess 83. The hood portion 87, as well as the wing portions 91, have abutting edges 93. The first portion 85 also comprises two abutting edges 93 as shown in FIGS. 8 and 9. The shield 49 and the inner connector housing 35 comprise locking members 95 which are used to lock the position of both elements when assembled.

In the inserted state 69*b*, as shown in FIG. 6B, the inner connector housing 35 and the cores 73 are inserted into the shield 49 along the plug direction 11. The inner connector housing 35 is received in the inner housing recess 83 and the cores 73 as well as parts of the cable 33 are received in a cable recess 97 which is formed by the hood portion 87 and the wing portions 91. In the inserted state 69*b*, the locking members 95 of the inner connector housing 35 and the shield 49 are locked to each other. The unshielded region 71 of the cable 33, that is the region exposing the cores 73, is entirely located in the cable recess 97 in the inserted state 69*b* and is thus electro-magnetically shielded by the shield 49. The cable recess 97 and the inner housing recess 83 have an angle of at least 135° to each other.

In the final state 69*c*, as shown in FIG. 6C, the hood portion 87 is tilted around the hinge line 89 from an orientation along the plug direction 11 by 45° to an orientation along the cable direction 19. By this tilting movement of the hood portion 87, the unshielded region 71 and the cores 73 are completely encircled by the hood portion 87 and the wing portions 91, whereas the abutting edges 93 of said portions are abutting each other. The shield 49, in a final crimp state 81*b*, receives the inner crimp ferrule 79 in the cable recess 97 and the outer crimp ferrule 77, which is the retaining element 78, partially encircles the wing portions 91 and the hood portion 87. The outer crimp ferrule 77 locks and/or secures the shield 49 by preventing the cable recess 97 from being opened. The hood portion 87 and the wing portions 91 enclosed by the retaining element 78 are entirely received in the cable receptacle 23 and are oriented along the cable direction 19. The first portion 85 of the shield 49 is oriented along the plug direction 11.

Figure 7A:
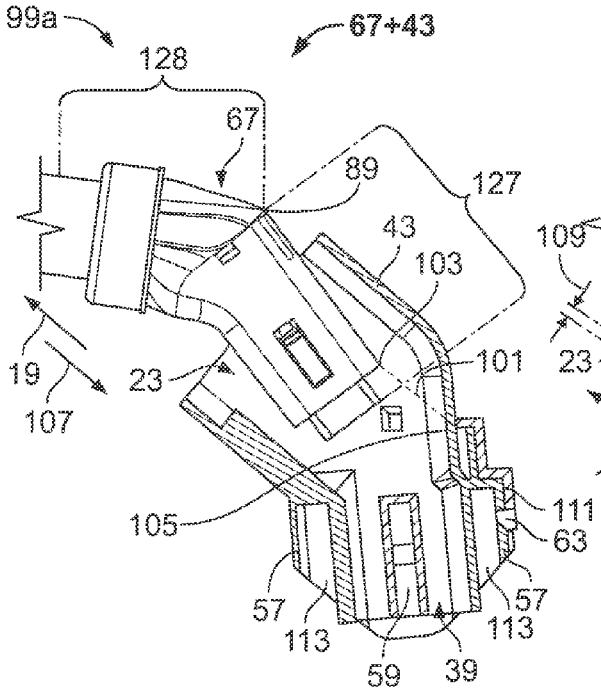
FIG. 7A is a side view of the connector insert and the connector housing in a first receiving phase.
Figure 7B:
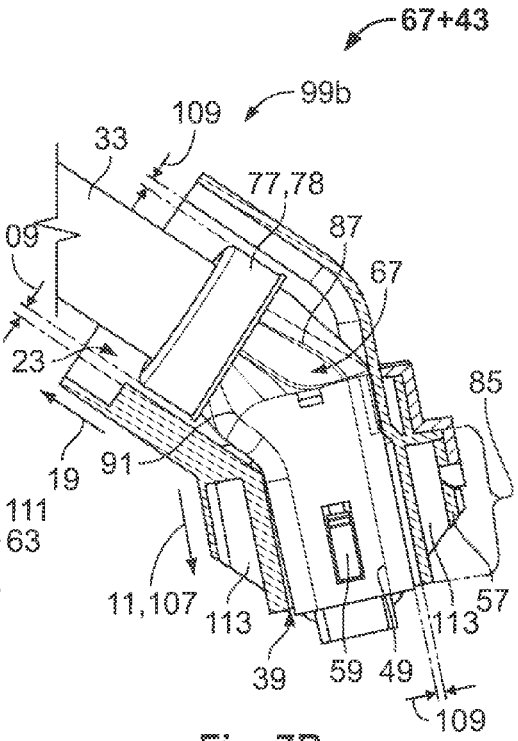
FIG. 7B is a side view of the connector insert and the connector housing in a third receiving phase.

The connector insert 67 is inserted into the outer housing 43 of the connector housing 3 in a first receiving phase 99*a* shown in FIG. 7A and a third receiving phase 99*b* shown in FIG. 7B. The connector insert 67 comprises a connector portion 127 and a cable portion 128. The connector portion 127 and the cable portion 128 have an angle of at least 135° to each other.

As shown in FIG. 7A, the connector insert 67 is inserted into the cable receptacle opposite the cable direction 19, which is indicated by a dashed line of movement 101, along which one corner 103 of the connector insert 67 moves during the first receiving phase 99*a* until said corner 103 touches an inside wall 105 of the outer housing 43. FIG. 7B shows the connector insert 67 and the outer housing 43 at the end of the third receiving phase 99*b* in which the first portion 85 of the shield 49 is entirely received in the connection receptacle 39 and the cable 33. During a second receiving phase 99*c*, between the first receiving phase 99*a* and the third receiving phase 99*b*, the connector insert 67 is rotated around the hinge line 89. The insertion direction 107 is oriented opposite to the cable direction 19 during the first receiving phase 99*a* and along the plug direction 11 during the third receiving phase 99*b*. During the second receiving phase 99*c* the insertion direction 107 is rotated by 45° about the hinge line 89 from the direction opposite to the cable direction 19 to the plug direction 11. In the third receiving phase 99*b*, a clearance 109 between the connector insert 67 and the cable receptacle 23 is larger than between the connector insert 67 and the connection receptacle 39.

A connector position assurance 59 of the connector housing assembly 1, as shown in part in FIGS. 7A and 7B, is part of the connection receptacle 39 of the connector housing assembly 1. The connector position assurance 59 includes the locking latch 61 and the detent hook 63. The connector position assurance 59 is surrounded by a seal receptacle 113 which is adapted to receive the peripheral seal and a peripheral seal retainer.

The shield 49 is shown in FIGS. 8 and 9. A connector shield 49*a*, shown in FIG. 8, is a portion of the shield 49 disposed in the connector housing 3 and a mating shield 49*b*, shown in FIG. 9, is a portion of the shield 49 disposed in the mating connector housing 5. Both shields 49*a*, 49*b* are pre-formed, that is for instance the wing portions 91 of the shield 49*a* are bent, or the first portion 85 of the shield 49*b* already forms an inner mating housing recess 115. FIGS. 8 and 9 also show the hinge line 89 which is enlarged in a zoom box 117 revealing the structure of the hinge line 89. The hinge lines 89 shown in FIGS. 8 and 9 comprise a weakened line 121 formed by a plurality of drill holes 119 oriented along the weakened line 121.

As shown in FIG. 8, the first wing abutting edges 93*a* of the shield 49*a* and the abutting edges 93 of the hood portion 87 are formed complementary to each other. The second wing abutting edges 93*b* are formed complementary to each other. The shield 49*a* further comprises several resilient clamping legs 94 which are adapted to primarily establish electrical contact with sufficient normal force between the shields 49*a*, 49*b*. Further, they may increase the mechanical release force to unplug the connector 4 from the mating electrical connector 6, and they may also act as locking members 95 in the form of detent hooks 63 or as locking recesses 123.

The second embodiment of the shield 49*b* shown in FIG. 9 also has the first portion 85, the hood portion 87 and two wing portions 91. The first portion 85 is similar for both shields 49*a*, 49*b*. The abutting edges 93 of the first portion 85 and the wing portions 91 are at least partially complementary to each other. The shield 49*b* further comprises one weakened line 121 oriented along the hinge line 89 and two weakened lines 121 oriented perpendicular to the hinge line 89, and a plurality of resilient clamping legs 94 extending from the hood portion 87 and the wing portions 91 away from the first portion 85. Said clamping legs 94 are adapted to establish electrical contact with sufficient normal force between the shield 49 and a machine wall.

Figure 10A:
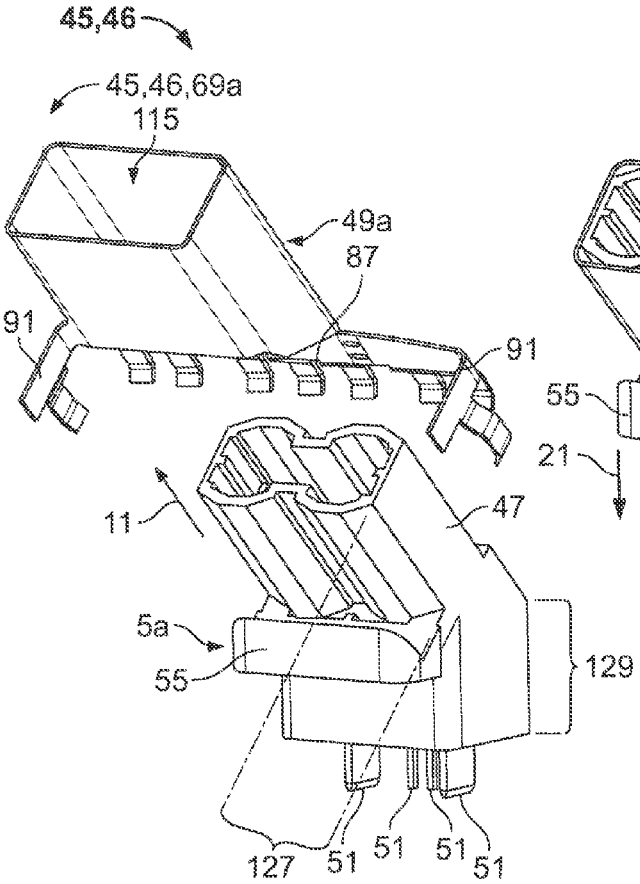
FIG. 10A is a perspective view of a mating connector insert in a pre-assembly state.
Figure 10B:
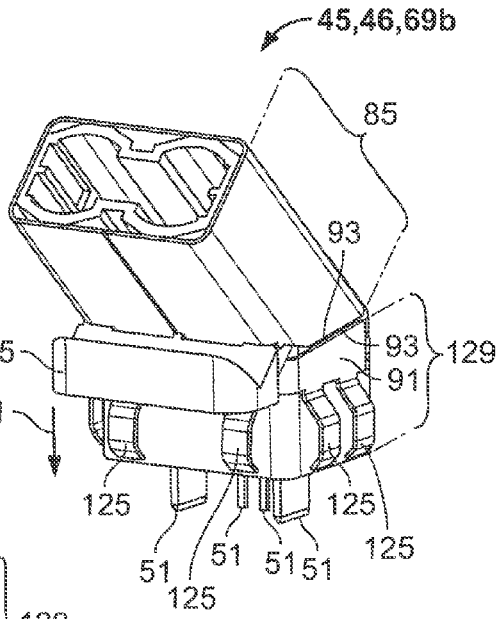
FIG. 10B is a perspective view of the mating connector insert in an inserted state.

A mating connector insert 45 formed as a header insert 46 for inserting into the mating connector housing 5 of the mating electrical connector 6 is shown in FIGS. 10A and 10B in a pre-assembly state 69*a* and an inserted state 69*b*.

In the pre-assembly state 69*a*, as shown in FIG. 10A, the inner mating connector housing 47 and the shield 49*a* are moved towards each other along or against the plug direction 11, wherein a connector portion 127 of the inner mating connector housing 47 is received in the inner mating housing recess 115 and a contact portion 129 is at least partially encircled by the hood portion 87 and the wing portions 91 of the shield 49*a*. The connector portion 127 and the contact portion 129 have an angle of at least 135° to each other.

In the inserted state 69*b*, as shown in FIG. 10B, the abutting edges 93 of the first portion 85 and the wing portions 91 at least partially abut each other because they are complementary to each other. The resilient clamping legs 94 are in engagement with the contact portion 129; the engagement may be a position or a frictional engagement. Contact elements 51 extend from the connector portion 127 to the contact portion 129 from which they extend in the contact direction 21.

Figure 11A:
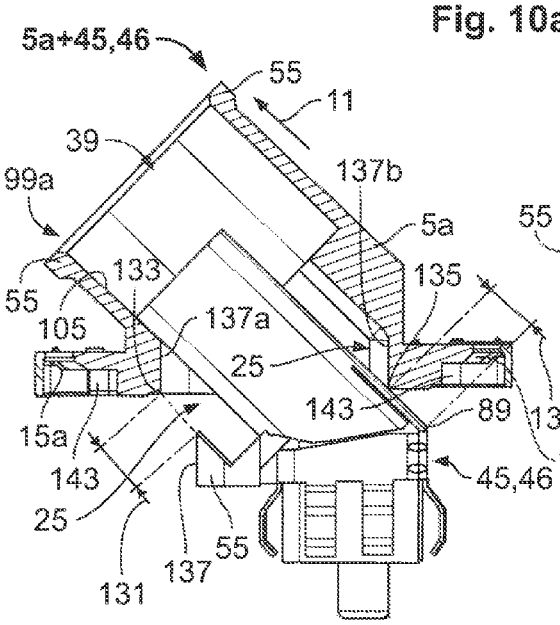
FIG. 11A is a side view of the mating connector insert and the mating connector housing in a first receiving phase.
Figure 11B:
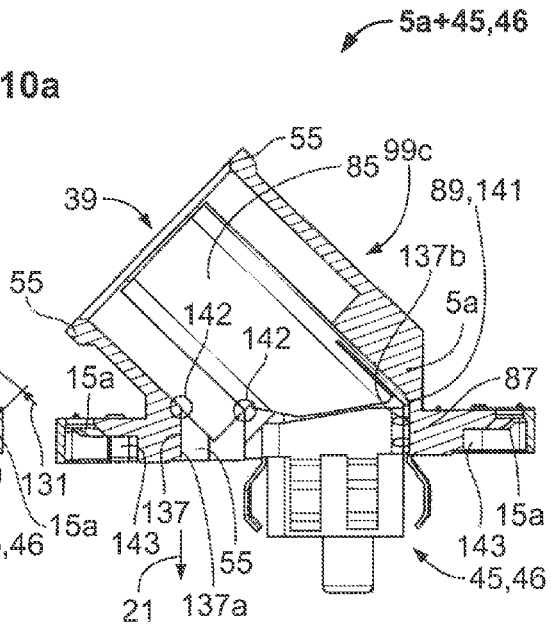
FIG. 11B is a side view of the mating connector insert and the mating connector housing in a third receiving phase.

Insertion of the header insert 46 into the mating connector housing 5 is shown in the first receiving phase 99*a* in FIG. 11A and the second receiving phase 99*c* in FIG. 11B.

In the first receiving phase 99*a*, the header insert 46 is inserted into the contact receptacle 25 along the plug direction 11. The header insert 46 passes the contact receptacle 25 and is received by the connection receptacle 39. During insertion of the header insert 46, the first portion 85 of the header insert 46 glides along and is guided by the inside wall 105 of the connection receptacle 39. The movement of the guiding member 55 is indicated by a dashed line illustrating a distance 131, which may also be measured between the hinge line 89 and a second mechanical contact point 135. If the header insert 46 is inserted into the header 5*a* over the distance 131, a further movement along the plug direction is prevented as the guiding member 55 touches the header 5*a* at the mechanical contact point 133.

The end of the second receiving phase 99*c* is shown in FIG. 11B. The header insert 46 is further inserted into the header 5*a* in a direction opposite to the contact direction 21. This movement of the header insert 46 is guided by a guide wall 137 of the guide member 55, which slides along and is guided by a second guide wall 137*a* located inside the contact receptacle 25 of the header 5*a*. A similar situation can be found close to the second mechanical contact point 135, where the hood portion 87 is guided along a third guide wall 137*b* which is also located inside the contact receptacle 25. If the header insert 46 is inserted completely into the header 5*a*, that is, the hinge line 89 touches the third mechanical contact point 141, the particular shape of the guiding member 55, located on one side of the mating connector inserts 45 contact portion 127, complements the shape of the inside wall 105 of the connection receptacle 39. In wall regions 142, no offset between the guiding member 55 and the inside wall 105 is present. The insertion movement of the header insert 46 furthermore results in a centering of the first portion 85 of the header insert 46 with respect to the opening of the connection receptacle 39.

The connector housing assembly 1 in a fully assembled position 2 is shown in FIG. 12 in the first position 7, in which the angle between the cable direction 19 and the contact direction 21 is 90°.

The cable 33 is inserted into the cable receptacle 23 in a direction opposite to the cable direction 19. The opening of the cable receptacle 23 is sealed by a cable seal 75 which is adapted to enclose the cable 33 and adapted to be located inside the cable receptacle 23. The cable seal 75 abuts against the cable seal retainer 41, by which the cable seal 75 is held. The cable seal 75 may also abut the outer crimp ferrule 77, the inner crimp ferrule 79 and the shield 49*a*.

Inside the cable recess 97, the cable 33 insulation is partially removed yielding the cores 73, whereas only one core 73 is visible in FIG. 12. Each core 73 itself has an insulation whereas this particular insulation is only removed to establish an electrical connection with a contact element 51 embodied as a plug socket 147. The lead-wires 149 of the cores 73 are attached to the plug socket 147, for instance by clamping or welding.

The inner connector housing 35 is received in the connection receptacle 39 of the shield 49*a*, abutting the shield 49*a* at its inside wall 105 and at the hinge line 89.

In the seal receptacle 113 of the outer housing 43, a peripheral seal 149, the peripheral seal retainer 37 as well as part of the mating connector housing 5 extending into the connecting section 13, are received. The peripheral seal retainer 37 abuts the peripheral seal 149 and the shield 49*a*, preventing both elements to be unintentionally removed from the electrical connector 4 in the plug direction 11 before reaching the first position 7.

The resilient clamping legs 94 of the shield 49*a* abut against the shield 49*b*, more precisely against the first portion 85 of the shield 49*b*.

The peripheral seal retainer 37 is inserted into the connection receptacle 39 of the mating connector housing 5 and is located between the header insert 46 and the inside wall 105 of the connection receptacle 39. As the connection receptacle 39 is offset-free in the wall regions 142, the insertion of the peripheral seal retainer 37 into the connection receptacle 39 is not prevented or blocked. The header insert 46 comprising the inner mating connector housing 47 and the shield 49*b* is firmly held in the contact receptacle 25 of the mating connector housing 5.

An electrical connection between the connector housing 3 and the mating connector housing 5 is established by the contact element 51 of the mating connector housing 5, embodied as tabs 151 which is monolithically formed and has an angle of 135° between its tip 153 and its end 155. The tip 153 of the tab 151 shows a chamfer for easy insertion into the plug socket 147. The tab 151 is inserted into the inner mating connector housing 47 against the plug direction 11 shown in FIG. 12. FIG. 12 further shows that the wing portions 91 of the shield 49*b* do not entirely abut the first portion 85 of the shield 49*b* and that the axial seal 17 is received in the seal groove 143, sealing the flange 15 against a wall.

What is claimed is:

1. A connector housing assembly, comprising:

a connector housing having a cable receptacle open in a cable direction; and a mating connector housing having a contact receptacle open in a contact direction, the mating connector housing connectable with the connector housing in a first position in which the cable direction and the contact direction are substantially perpendicular to each other and a second position in which the cable direction and contact direction are substantially parallel to each other and the cable receptacle and the contact receptacle are offset by an offset distance in a lateral direction perpendicular to the cable direction and the contact direction, the connector housing and the mating connector housing are connected by being moved along a plug direction toward each other, and in the second position, one of the connector housing and the mating connector housing is rotated about the plug direction from the first position.

2. The connector housing assembly of claim 1, wherein the connector housing and the mating connector housing are connected at a connecting section, the cable receptacle is located at an end of the connector housing opposite the connecting section and the contact receptacle is located at an end of the mating connector housing opposite the connecting section.

3. The connector housing of claim 1, wherein the cable direction and the plug direction are at an angle of at least 45° to each other and the contact direction and the plug direction are at an angle of at least 45° to each other.

4. An electrical connector assembly, comprising:

an electrical connector having a connector housing with a cable receptacle open in a cable direction and an electrical conductor disposed in the cable receptacle; and a mating electrical connector having a mating connector housing with a contact receptacle open in a contact direction and a mating electrical conductor disposed in the contact receptacle, the electrical connector matable with the mating electrical connector in a first position in which the electrical conductor and the mating electrical conductor are substantially perpendicular to each other and a second position in which the electrical conductor and the mating electrical conductor are substantially parallel to each other and the cable receptacle and the contact receptacle are offset by an offset distance in a lateral direction perpendicular to the cable direction and the contact direction, the electrical connector and the mating electrical connector are connected at a connection section by being moved along a plug direction towards each other, the cable receptacle located at an end of the connector housing opposite the connecting section and the contact receptacle located at an end of the mating connector housing opposite the connecting section, and in the second position, one of the connector housing and the mating connector housing is rotated about the plug direction from the first position.

5. The electrical connector assembly of claim 4, further comprising a connector insert inserted into the connector housing opposite the cable direction and extending from the connecting section to the cable receptacle, the connector insert having a cable portion and a first connector portion.

6. The electrical connector assembly of claim 5, further comprising a mating connector insert inserted into the mating connector housing opposite the plug direction and extending from the connecting section to the contact receptacle, the mating connector insert having a contact portion and a second connector portion.

7. The electrical connector assembly of claim 6, wherein the cable portion and the first connector portion have an angle of at least 135° to each other and the contact portion and the second connector portion have an angle of at least 135° to each other.

8. The electrical connector assembly of claim 6, wherein the connector insert has a connector shield with a cable recess and an inner housing recess, the cable recess and the inner housing recess have an angle of at least 135° to each other.

9. The electrical connector assembly of claim 8, wherein the connector shield has a hood portion.

10. The electrical connector assembly of claim 9, wherein the hood portion is tiltable along a hinge line.

11. The electrical connector assembly of claim 8, wherein a retaining element of the connector insert retains the connector shield.

12. The electrical connector assembly of claim 5, wherein a clearance between the connector insert and the connector housing is smaller in the connecting section than in the cable receptacle.

13. The electrical connector assembly of claim 6, wherein the connector insert is inserted into the connector housing from an end opposite the connecting section and the mating connector insert is inserted in the mating connector housing from an end opposite the connecting section.

14. The electrical connector assembly of claim 6, wherein the mating electrical connector is a header and the mating connector housing is a header housing.

15. The electrical connector assembly of claim 14, wherein the mating connector insert is a header insert.

16. The electrical connector assembly of claim 15, wherein the mating connector housing has a plurality of tabs each having an angle of 135° between a tip and an end of the tab, the plurality of tabs inserted into the header insert in the plug direction.

17. The electrical connector assembly of claim 16, wherein the header housing receives the header insert from a contact side of the header housing.

* * * * *